US011162664B1

(12) United States Patent
Lu et al.

(10) Patent No.: US 11,162,664 B1
(45) Date of Patent: Nov. 2, 2021

(54) LAMP TUBE

(71) Applicant: Xiamen PVTECH Co., Ltd., Fujian (CN)

(72) Inventors: Fuxing Lu, Fujian (CN); Sishan Liao, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/019,388

(22) Filed: Sep. 14, 2020

(30) Foreign Application Priority Data

Jun. 18, 2020 (CN) ..... 202010558220.1

(51) Int. Cl.

| | |
|---|---|
| ***F21V 15/015*** | (2006.01) |
| ***F21K 9/278*** | (2016.01) |
| ***F21V 23/02*** | (2006.01) |
| ***F21K 9/272*** | (2016.01) |
| ***F21Y 103/10*** | (2016.01) |
| ***F21Y 115/10*** | (2016.01) |

(52) U.S. Cl.
CPC ..... *F21V 15/015* (2013.01); *F21K 9/272* (2016.08); *F21K 9/278* (2016.08); *F21V 23/02* (2013.01); *F21V 23/023* (2013.01); *F21Y 2103/10* (2016.08); *F21Y 2115/10* (2016.08)

(58) Field of Classification Search
CPC ..... F21K 9/272; F21K 9/278
See application file for complete search history.

(56) References Cited

U.S. PATENT DOCUMENTS

| | | | | |
|---|---|---|---|---|
| 7,052,171 | B1 * | 5/2006 | Lefebvre | F21K 9/27 362/649 |
| 10,088,142 | B1 * | 10/2018 | McGrath | F21K 9/272 |
| 10,371,323 | B2 * | 8/2019 | Mayer | H01R 33/0827 |
| 10,749,303 | B2 * | 8/2020 | Lu | H01R 33/942 |
| 2010/0277918 | A1 * | 11/2010 | Chen | H01R 33/942 362/249.02 |
| 2012/0008315 | A1 * | 1/2012 | Simon | F21V 21/005 362/217.13 |
| 2012/0212951 | A1 * | 8/2012 | Lai | H05B 45/00 362/218 |
| 2013/0016503 | A1 * | 1/2013 | Ku | F21V 23/007 362/217.13 |
| 2014/0036491 | A1 * | 2/2014 | Su | F21V 23/06 362/217.17 |
| 2014/0087571 | A1 * | 3/2014 | Su | H01R 12/7088 439/57 |
| 2014/0286004 | A1 * | 9/2014 | Su | F21V 21/14 362/218 |
| 2017/0314741 | A1 * | 11/2017 | Gleeson | F21V 17/08 |

* cited by examiner

*Primary Examiner* — Alexander K Garlen
(74) *Attorney, Agent, or Firm* — Winston Hsu

(57) ABSTRACT

The present invention provides a lamp tube, including a lamp body, multiple lamp head mounters and multiple lamp heads. The lamp body comprising a housing, a light source board disposed inside the housing. Each lamp head mounter is provided with a mounting portion, each mounting portion can be detachably assembled with the lamp body and the lamp heads, so as to conveniently combine the lamp heads with two ends of the lamp body. Since the lamp body and the lamp heads are separately packaged and shipped, the lamp tube in accordance with present invention is easily for transportation.

6 Claims, 6 Drawing Sheets

LAMP TUBE

CROSS REFERENCE TO RELATED APPLICATION

This application claims priority to China Patent Application No. 202010558220.1, filed 2020 Jun. 18, and included herein by reference in its entirety.

BACKGROUND OF THE INVENTION

1. Field of the Invention

The present invention relates to a lamp, in particular to a lamp tube.

2. Description of the Prior Art

A light-emitting diode (LED) lamp mainly includes a tube body, a light-emitting module, a driving circuit and multiple electrical connectors. The light-emitting module is housed in the tube body and contains a circuit board and multiple light-emitting units, which are arranged on the circuit board and electrically connected to the circuit board. The circuit is defined on the circuit board and electrically connected to the light-emitting units; each electrical connector is hermetically coupled to both ends of the tube, and the electrical connectors are also hermetically coupled. Separately soldered electrical connection to the driver circuit.

Problems arising from said conventional LED lamps:

1. After the assembly of the conventional LED lamps, the power supply positioned in the lamp cannot be moved or adjusted. The light effect problems (such as dark spot) need whole LED lamps to be reworked to improve.
2. When assembling the conventional light-emitting diode lamp products, due to the long lamp head, it is difficult to penetrate the connection pins into the pin holes of the lamp head, resulting in inconvenience for the assembly operation of the lamp head.
3. After the assembly of conventional light-emitting diode lamp products, because the power supply is inside the sealed lamp body, it is impossible to reach and adjust the parameters of the power supply.
4. Since conventional LED lighting products are shipped with connection pins located on fixed lamp heads, the packaging materials need to consider additional measures to protect the connection pins, resulting in higher packaging costs.

SUMMARY OF THE INVENTION

In view of the above problem, an objective of the present invention is to provide a lamp tube, including a lamp body, multiple lamp head mounter and multiple lamp head. The lamp body including a housing, a light source board disposed inside the housing. The lamp head mounter detachably mounted to both ends of the housing, each lamp head mounter has a mounting portion formed inside the lamp head mounter. The lamp heads are detachably mounted to the mounting portions of the lamp head mounter, so that the lamp head is to be conveniently assembled to or detached from the ends of the lamp body.

According to a preferred embodiment of a lamp tube as mentioned, wherein the mounting portion has a mounting wall formed within the lamp head mounter, and multiple spaced mounting holes formed on the mounting wall.

According to a preferred embodiment of a lamp tube as mentioned, a guiding ramp is formed on the side edges of the mounting holes.

According to a preferred embodiment of the above mentioned lamp tube, wherein the lamp head comprises a lamp head cap and multiple connection pins mounted in a side of the lamp head cap. The connection pins can electrically connected to the light source board for providing power.

According to a preferred embodiment of the lamp tube as mentioned, which moreover includes a power supply, is disposed inside the lamp body and electrically connected to the light source board and connection pins for providing power.

In view of the above, an embodiment of the present invention proposes a lamp tube, comprises a lamp body comprising a housing, a light source board disposed inside the housing; multiple lamp head mounter detachably mounted at the ends of the housing; and multiple lamp head detachably mounted in the lamp head mounter respectively; wherein each of the lamp head mounters has a mounting portion; and each of the lamp head has an engaging part longitudinally formed in a side of the lamp head; the engaging part is extended and engaged with the mounting portion of the lamp head mounter, so as to detachably mount the lamp head with the lamp head mounter and the lamp body.

In view of the above, an embodiment of the present invention proposes a lamp tube, wherein the mounting portion comprises a mounting wall formed within the lamp head mounter, and multiple mounting holes separately formed in the mounting wall; the engaging part of the lamp head has multiple arms formed on a side edge of the lamp head and multiple hook portions formed on the arms.

In view of the above, an embodiment of the present invention proposes a lamp tube, wherein the mounting hole has a guiding ramp formed at an edge thereof; the hook portion also has a guiding ramp formed on a side.

In view of the above, an embodiment of the present invention proposes a lamp tube, wherein the lamp head comprise a lamp head cap and multiple connection pins mounted in the lamp head cap.

In view of the above, an embodiment of the present invention proposes a lamp tube, further comprises a power supply disposed inside the lamp body.

In summary, the lamp tube according to one or more embodiments of the present invention has the following features: the lamp body provide convenience for assembly and detaching for shipping. When the user needs to assemble the lamp, just take out each lamp body, lamp head mounter and lamp head and assemble them together. After the lamp body is assembled, power supply parts in the lamp body is still reachable for adjustment, so as to avoid whole lamp reworking. The connection pins are mounted in the lamp head, which are separately disposed and are short and easy to thread through the power wiring. After the lamp body is assembled, a user can manually adjust a switch or button of the power supply near the end through the holes on both ends of the lamp, such as to adjust the parameters of the power supply.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

These and other features, aspects and advantages of the invention will become better understood with regard to the following embodiments and accompanying drawings.

DETAILED DESCRIPTION

In order to illustrate in detail the technical content, structural features, achieved purposes and effects of the technical solution, the following are combined with specific examples and with the accompanying drawings detailed description.

Figure 1:
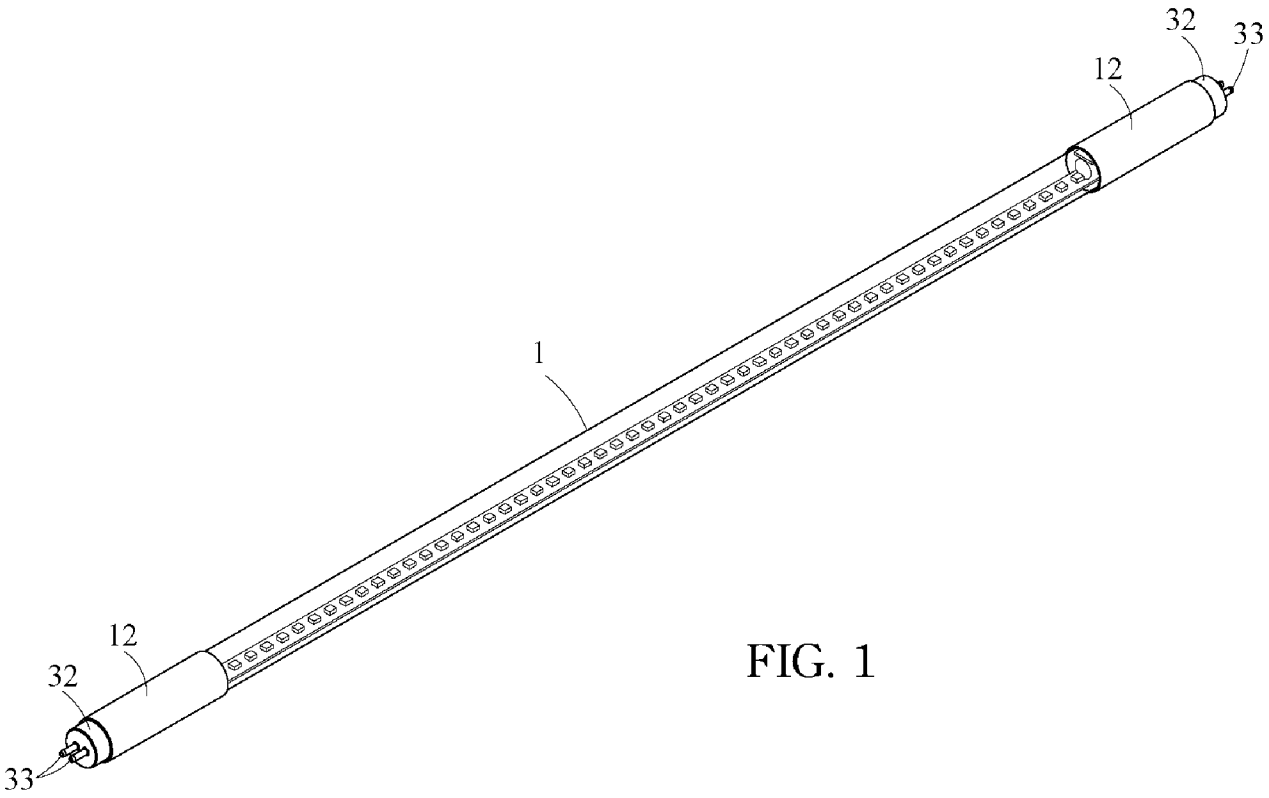
FIG. 1 is a schematic diagram of the appearance of an embodiment of the present invention.
Figure 2:
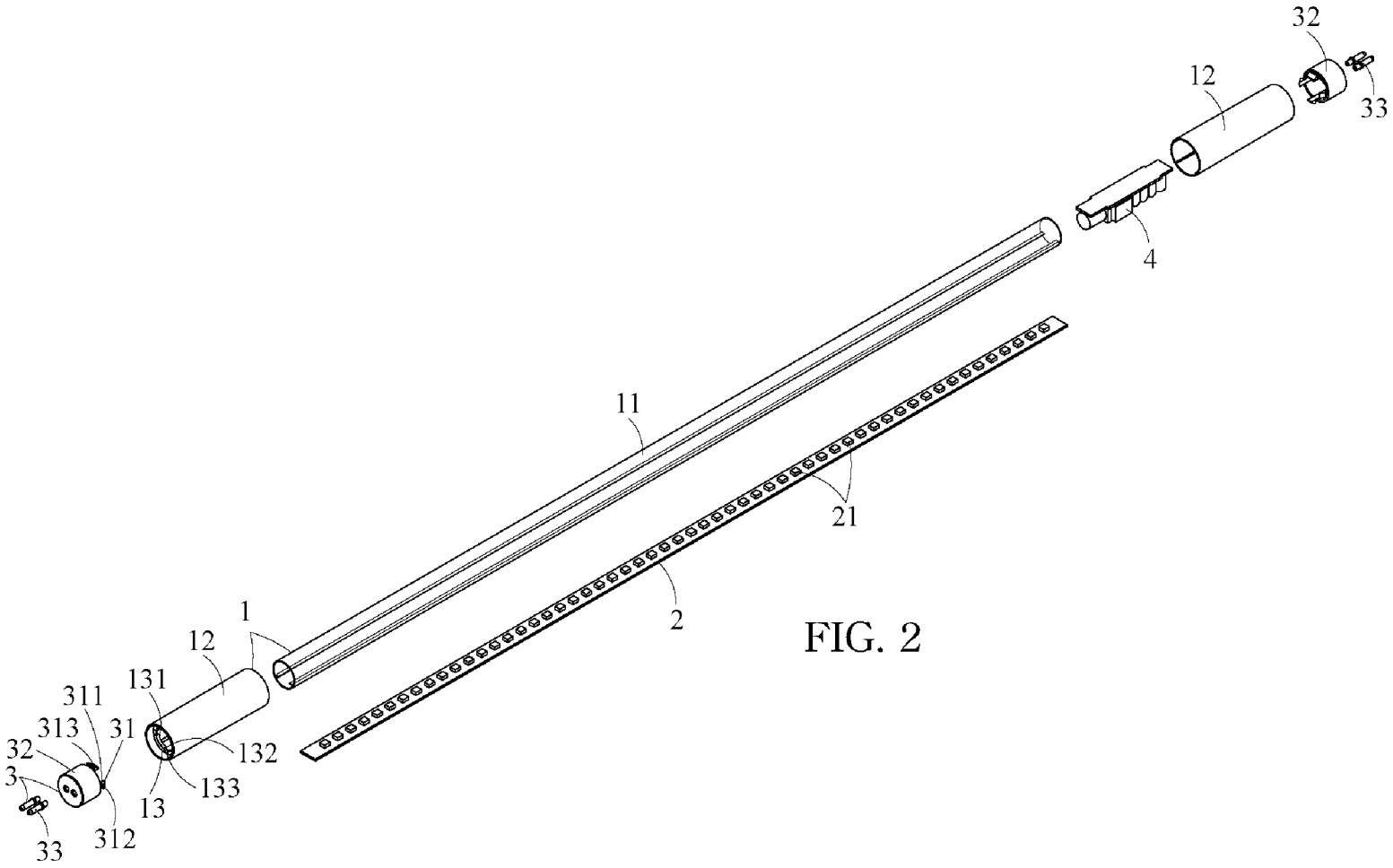
FIG. 2 is an explosive diagram of an embodiment of the present invention.
Figure 3:
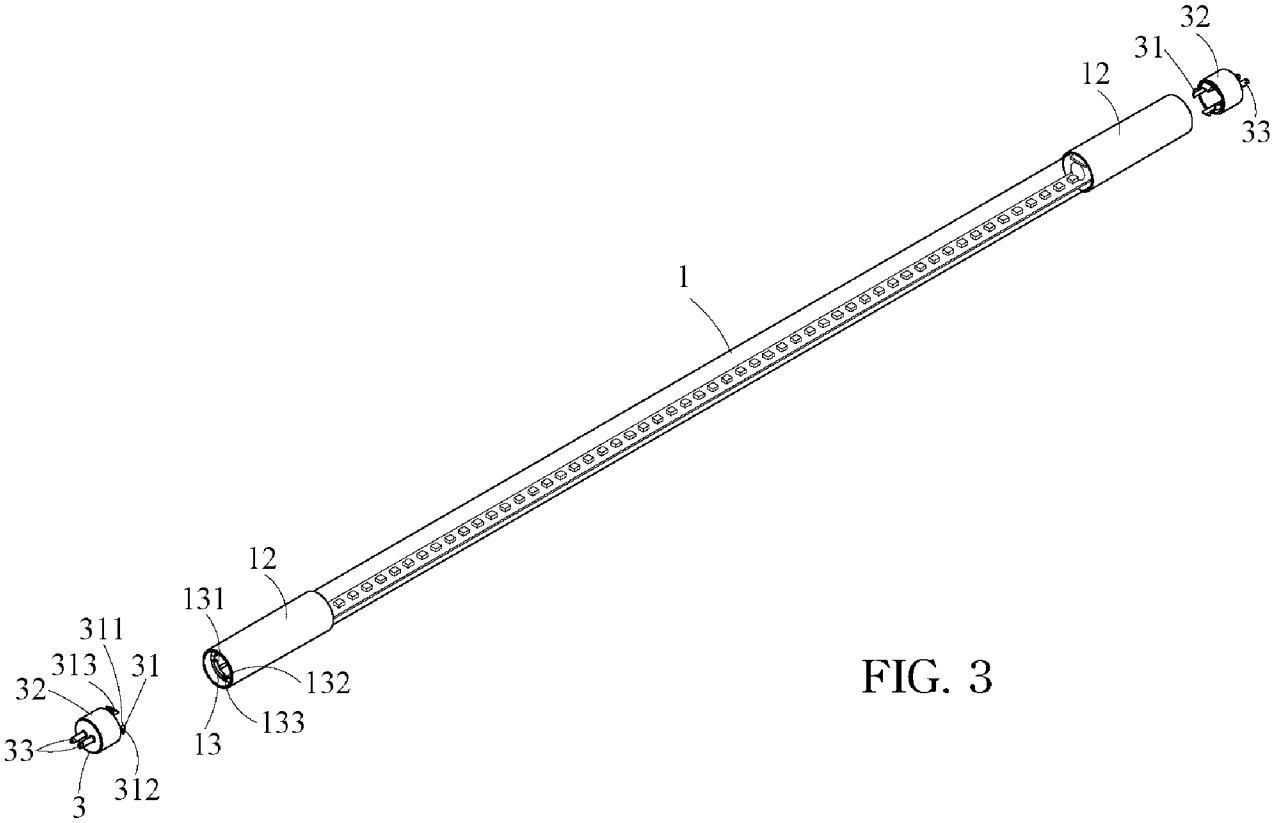
FIG. 3 is an explosive diagram of the decomposition of the embodiment of the present invention when assembled.
Figure 4:
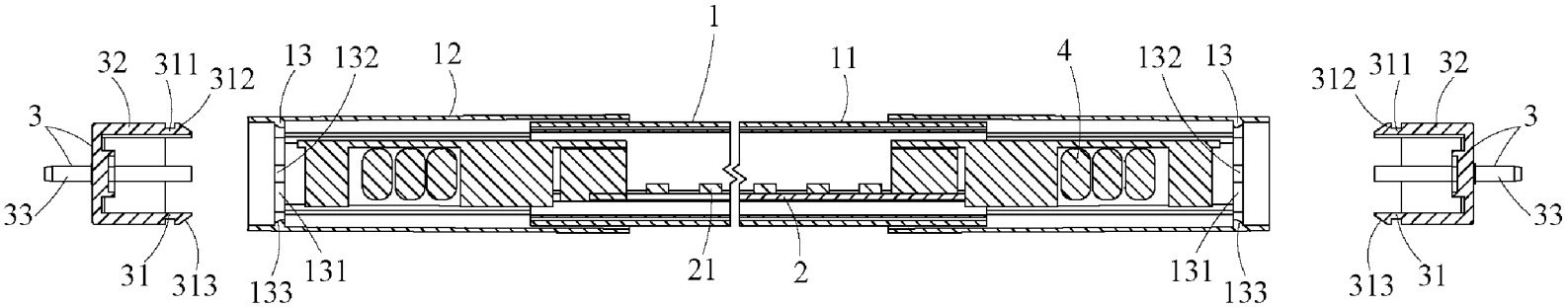
FIG. 4 is a schematic diagram of a side view section when the embodiment of the present invention is assembled.
Figure 5:
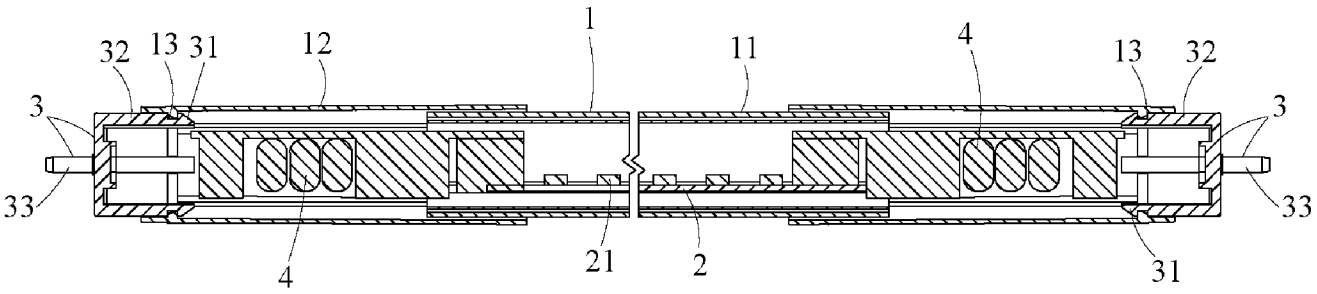
FIG. 5 is a schematic diagram of the side view section after assembly of an embodiment of the present invention.
Figure 6:
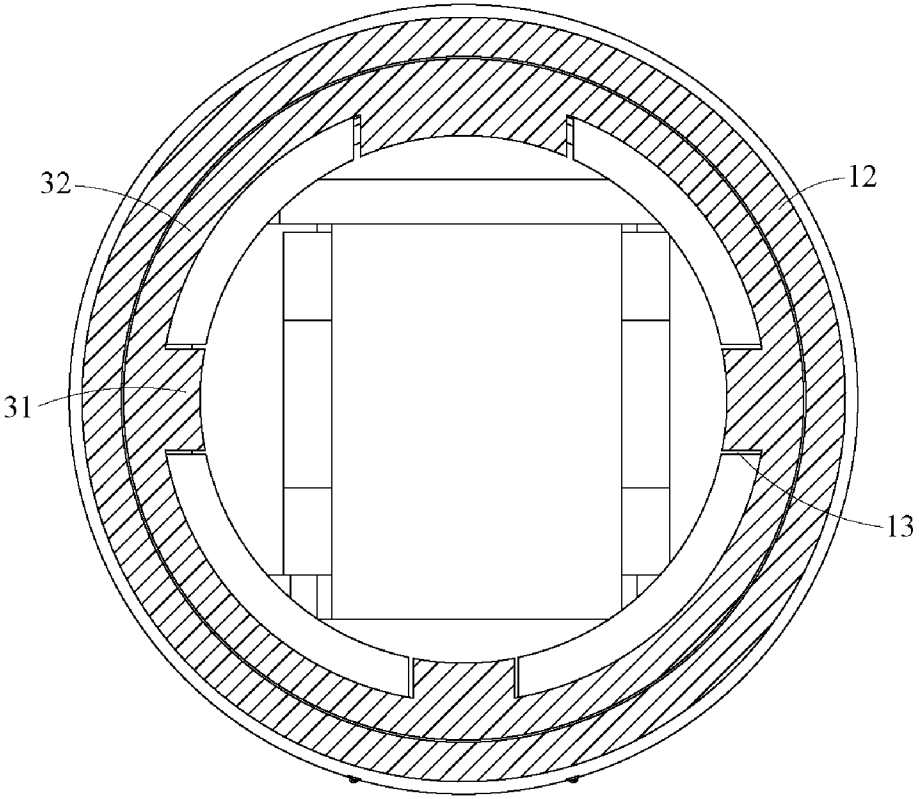
FIG. 6 is a schematic diagram of the front view section of the embodiment of the present invention.

Referring to FIGS. 1 and 2 that illustrate a schematic diagram and an explosive diagram of an embodiment of the lamp tube of the present invention.

The embodiment of the present invention is a lamp tube comprising a long tube type lamp body 1 including a housing 11. The housing 11 is made of a transparent or translucent material.

In this embodiment, the lamp tube comprises a light source board 2 disposed inside the housing 11, the light source board 2 having multiple LEDs 21 that separately arranged on the light source board.

In this embodiment, the lamp tube includes multiple lamp head mounters 12 detachably mounted at both ends of the housing 11, each lamp head mounter 12 has a mounting portion 13 formed inside. In detail, the lamp head mounter 12 is a round tube, and the inner diameter of the lamp head mounter 12 is equal to or greater than the outer diameter of the housing 11, and the lamp head mounter 12 is fitted to the outside of the housing 11. Also, the housing 11 is fixed with one end of the lamp head mounter 12.

Referring to FIGS. 3, 4, 5, and 6, a schematic diagram of the disassembly of the lamp tube embodiment, a side view section diagram, the assembled side view section diagram and the front view section diagram. In the embodiment of the present invention, each the mounting portion 13 can be detachably assembled with a lamp head 3. In such way, the lamp head 3 is to be assembled with the lamp body 1 in two ends thereof. When the user needs to assemble the lamp, just take out each lamp body 1, lamp head mounter 12 and lamp head 3 and assemble them together.

In this embodiment, in more detail, the lamp head mounter 12 has a mounting wall 131 formed inside the mounting portion 13, and multiple separately formed mounting holes 132 formed on the mounting wall 131, wherein a guiding ramp 133 is formed on the side edges of the mounting holes 132. Each of the lamp head 3 has an engaging part 31 longitudinally formed in a side of the lamp head 3; the engaging part 31 is extended and engaged with the mounting portion 13 of the lamp head mounter 12, so as to detachably mount the lamp head 3 with the lamp head mounter 12 and the lamp body 1.

The engaging part 31 of the lamp head 3 has multiple arms 311 formed on a side edge of the lamp head 3 and multiple hook portions formed on the arms 311. A guiding ramp 313 is formed on a side of the hook portion 312.

By aligning the engaging parts 31 of the lamp heads 3 with each of the mounting holes 132 and inserting them into the mounting holes 132, the guiding ramp 313 on the hook 312 slides and pushes into the mounting holes 132. The guiding ramp 133 on the mounting holes 132 can be applied to install the lamp heads 3 on both sides of the lamp body 1, which is easy to install and saves energy.

In this embodiment, in more detail, the lamp head 3 includes a lamp head cap 32 and multiple connection pins 33. In Detail, the lamp head cap 32 is a round tube body with an outer diameter less than or equal to the inner diameter of the lamp head mounter 12. Such that the lamp head cap 32 is secured within the lamp head mounter 12.

In embodiments of the present invention, in more detail, the lamp tube moreover includes a power supply 4, which is disposed inside the lamp body 1 and supplies power to the light source board 2.

In summary, the lamp tube according to one or more embodiments of the present invention has the following features: the lamp body provide convenience for assembly and detaching for shipping. When the user needs to assemble the lamp, just take out each lamp body 1, lamp head mounter 12 and lamp head 3 and assemble them together. After the lamp body is assembled, power supply parts in the lamp body is still reachable for adjustment, so as to avoid whole lamp reworking. The connection pins 33 are mounted in the lamp head 3, which are separately disposed and are short and easy to thread through the power wiring. After the lamp body is assembled, a user can manually adjust a switch or button of the power supply near the end through the holes on both ends of the lamp, such as to adjust the parameters of the power supply.

It should be noted that although each of these embodiments has been described herein, it does not thereby limit the patent protection of the invention scope. Accordingly, changes and modifications to the embodiments described herein based on the innovative ideas of the present invention, or using the specification and accompanying drawings of the present invention equivalent structures or equivalent process transformations of the content, which directly or indirectly apply the above technical solutions to other relevant technical areas. are all included in the scope of protection of the patent of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp tube, comprises:

a lamp body comprising a housing and a light source board disposed in the housing;

multiple lamp head mounters detachably mounted at both ends of the housing, each of the lamp head mounters having a mounting portion, wherein the mounting portion comprises a mounting wall formed in the lamp head mounter, and multiple mounting holes separately formed in the mounting wall, wherein each of the mounting holes has a guiding ramp formed at an edge thereof; and multiple lamp heads detachably mounted to the mounting portions of the lamp head mounters, wherein each of the lamp head has an engaging part longitudinally formed in a side of the lamp head, whereby the engaging part is inserted into the mounting holes in a direction parallel to the lamp body and engaged with the mounting portion of the lamp head mounter.

2. The lamp tube as claimed in claim 1, wherein each of the lamp heads includes a lamp head cap and multiple connection pins mounted in the lamp head cap.

3. The lamp tube as claimed in claim 1, further comprises a power supply disposed inside the lamp body.

4. A lamp tube, comprises:

a lamp body comprising a housing, a light source board disposed inside the housing;

multiple lamp head mounter detachably mounted at the ends of the housing; and multiple lamp head detachably mounted in the lamp head mounter respectively;

wherein each of the lamp head mounters has a mounting portion and the mounting portion comprises a mounting wall formed within the lamp head mounter, wherein multiple mounting holes separately formed in the mounting wall and a guiding ramp of each of the mounting holes is formed at an edge thereof, wherein each of the lamp head has an engaging part longitudinally formed in a side of the lamp head and the engaging part of the lamp head has multiple arms formed on a side edge of the lamp head, wherein multiple hook portions formed on the arms and a guiding ramp of each of the hook portions is formed on a side thereof, whereby the engaging part is inserted in to the mounting holes in a direction parallel to the lamp body and engaged with the mounting portion of the lamp head mounter so as to detachably mount the lamp head with the lamp head mounter and the lamp body.

5. The lamp tube as claimed in claim 4, further comprises a power supply disposed inside the lamp body.

6. The lamp tube as claimed in claim 4, wherein the lamp head comprise a lamp head cap and multiple connection pins mounted in the lamp head cap.

* * * * *